United States Patent [19]

Feuillerat et al.

[11] Patent Number: 4,997,475

[45] Date of Patent: Mar. 5, 1991

[54] METHOD AND DEVICE FOR MOUNTING AND WITHDRAWING A PLASMA TORCH RELATIVE TO AN APPARATUS OPERATING UNDER PRESSURE AND TEMPERATURE CONDITIONS PRECLUDING A DIRECT INTERVENTION

[75] Inventors: Jean Feuillerat, Bordeaux; Yves H. G. Valy, Issac, both of France

[73] Assignee: Aerospatiale Societe Nationale Industrielle, Paris, France

[21] Appl. No.: 412,860

[22] Filed: Sep. 26, 1989

[30] Foreign Application Priority Data

Oct. 3, 1988 [FR] France ..... 88 12899

[51] Int. Cl.[5] ..... C22B 9/00; H05H 1/26

[52] U.S. Cl. ..... 75/10.19; 75/10.22; 266/47; 266/265; 266/271; 373/18

[58] Field of Search ..... 373/18, 19, 24; 75/10.19, 10.22; 266/47, 265, 271

[56] References Cited

U.S. PATENT DOCUMENTS

| | | | |
|---|---|---|---|
| 4,638,489 | 1/1987 | Thornblom et al. | 373/24 |
| 4,670,048 | 6/1987 | Pineau | 75/10.22 |
| 4,769,065 | 9/1988 | Dighe et al. | 75/10.22 |

*Primary Examiner*—Melvyn J. Andrews

*Attorney, Agent, or Firm*—Martin Smolowitz

[57] ABSTRACT

A method and device for forming a modifiable closed volume (16) by means of an extensible and retractable tubular element (16) fixed around the orifice of a sleeve (3) closed by a valve (5) on the upstream side of the valve, and detachably fixed around the nose (12) of the torch (4), and balancing the pressure in the volume (16) on the upstream side of the valve with the pressure prevailing on the downstream side of the valve by a device (20, S), opening the valve and reducing the volume (16) by advancing to the mounted position the nose (12) of the torch and locking the torch (4) on a sealing element (7) of the sleeve.

9 Claims, 3 Drawing Sheets

METHOD AND DEVICE FOR MOUNTING AND WITHDRAWING A PLASMA TORCH RELATIVE TO AN APPARATUS OPERATING UNDER PRESSURE AND TEMPERATURE CONDITIONS PRECLUDING A DIRECT INTERVENTION

BACKGROUND OF THE INVENTION

The present invention relates to a method and a device for mounting and withdrawing an plasma torch relative to a installation operating under conditions of high pressure and temperature.

Plasma torches of the type having a non-transferred arc are employed in a number of installations or apparatus whose operation involves pressure and temperature conditions which preclude any direct intervention for mounting or withdrawing the torch. Under these conditions, the mounting or the withdrawal of the plasma torch requires a change in the conditions of operation of the installation or apparatus, in particular a temporary reduction in the pressure and possibly temperature operating conditions, which are detrimental from every point of view.

As the industrial development of the technique of plasma torches is generally relatively recent, there are at the present time few devices for operating these torches in industrial apparatus. As an example which characterizes an installation in which plasma torches are employed, there may be mentioned blast furnaces, and it is with respect to such an application that the invention will be described.

Plasma torches are employed in blast furnaces for superheating the hot blast coming from the cowpers before its injection into the apparatus. The injection of the hot blast is effected by means of a pipe or blast pipe to which there is connected by one end an inclined sleeve, for example as described in U.S. Pat. No. 4,670,048 of the applicant, and the nose of the torch is inserted in the opposite end of this sleeve. This sleeve must be as short as possible so as to reduce heat losses.

For the purpose of mounting in position and withdrawing the torch, the blast flow in the blast pipe must be reduced to a sufficently low pressure, on the order of about 400 mb or less and, owing to the temperature and the slight flow of hot gas, the operation is carried out under difficult conditions and results in production losses which are proportional to the duration of the change in the operating conditions of the blast furnace.

Various solutions have been envisaged for solving this problem by the use of one or more valves for isolating the nose of the torch from the blast pipe. In a first solution, a volume of the blast pipe was isolated by means of two valves disposed respectively on the upstream side and the downstream side of the sleeve receiving the nose of the torch so as to be able to put this volume under atmospheric pressure for carrying out the required operations. This arrangement permits operating the valves under acceptable conditions of $\Delta P$. However, it presents an important drawback in that it requires a major modification of the pipes of the blast furnace, whose large diameter requires the use of valves of large size resulting in high costs.

In another solution, a valve was interposed in a longer sleeve immediately on the downstream side of the nose of the torch, whereby it is possible to employ a valve having dimensions which are smaller than the foregoing dimensions. But this arrangement requires increasing the length of the sleeve, which increases the heat losses at the connecting interface and modifies the mixing conditions. Furthermore, in this solution, the valve and the refractory lining of the sleeve are partly exposed to the thermal flow of the plasma and therefore require an effective cooling by means of expensive cooling devices.

In a third arrangement, a short sleeve having just the length of the nose of the torch was provided and a valve was interposed mid-way along its length. The heat losses were in this way avoided and the valve was shielded from the harmful effects of the plasma jet. On the other hand, the valve operates under bad conditions as concerns $\Delta P$, having for result deformations which hinder its operation, and leakages. Lastly, this third arrangement prevents closing the valve when the torch is in position and leakages of hot gas occur when the torch is withdrawn, before closing the valve.

SUMMARY OF THE INVENTION

An object of the invention is to overcome these drawbacks of known arrangements by providing a cheap method and device for mounting and withdrawing a plasma torch having a non-transferred arc relative to a sleeve, the device comprising a shut-off valve communicating with a blast pipe of an installation or an apparatus operating under high pressure and high temperature conditions:

which does not require a modification in the operating conditions of the apparatus, which is reliable and convenient and can be adapted to an existing apparatus comprising a short sleeve, without modification of the apparatus.

For attaining these objects, the invention provides a method for mounting a plasma torch having a non-transferred arc on one end of a sleeve, which includes a shut-off valve and communicates with a blast pipe of an apparatus operating under high temperature and pressure conditions, comprising, for mounting the torch:

(a) forming a modifiable closed volume on the upstream side of the valve between the latter and the end of the torch, (b) balancing the pressure in said volume with the pressure prevailing on the downstream side of the valve, (c) opening the valve, and (d) reducing said volume by advancing the nose of the torch to the mounted position through said valve.

The invention also provides a device for carrying out the method defined hereinbefore, said device comprising, on the upstream side of the valve, an extensible and retractable tubular element fixed in a sealed manner, by one end, around the end of the sleeve adapted to receive the nose of the torch and, by its other end around this nose, means for balancing the pressure in said element with that prevaling on the downstream side of the valve, and means for cooling said tubular element.

Advantageously, said tubular element is fixed around the nose of the torch in a detachable manner, complementary sealing means being provided on said element and on the torch and mutual locking means being provided for said element on the torch.

According to another feature of the invention, said means for balancing the pressure in said element with that on the downstream side of the shut-off valve comprise a pipe connecting the interior of the shut-off valve to a source of compressed air through a pilot pressure reducing valve connected to the downstream side of the valve through a tap valve.

The following description, with reference to the accompanying drawings given by way of non-limitative example, will explain how the invention may be carried out.

DESCRIPTION OF THE PREFERRED EMBODIMENTS

Figure 1:
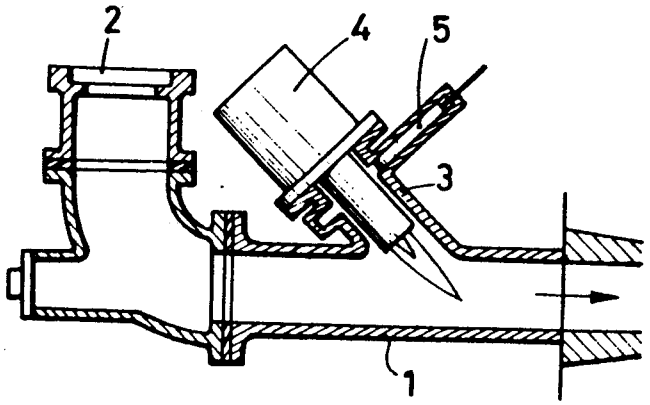
FIG. 1 PRIOR ART
FIG. 1 is a diagrammatic sectional view of a known arrangement of a plasma torch on a sleeve connected to a blast pipe arranged for injecting a hot blast into a blast furnace.

FIG. 1 shows a diagram of a known arrangement in which reference numeral 1 designates a blast pipe for injecting a hot blast into a blast furnace, the arrangement comprising a blast inlet 2 and an inclined sleeve 3 for the connection of a plasma torch 4 of the non-transferred arc type, this sleeve 3 being provided with a closable valve 5 located roughly mid-way of the sleeve length.

With this arrangement, the valves operates under bad conditions of $\Delta P$, which caused deformations of the closure member of the valve resulting in difficulties in the operation of the latter, sealing defects and leakages. Furthermore, in the interval of time between the start of the withdrawal of the torch 4 and the closure of the shut-off valve 5, a leakage of hot gas occurs at the rear of the sleeve 3 which renders the operations difficult. Indeed, the relative positions of the elements involved preclude having the torch 4 in position and the valves closed simultaneously. This device is therefore unsatisfactory.

Figure 2:
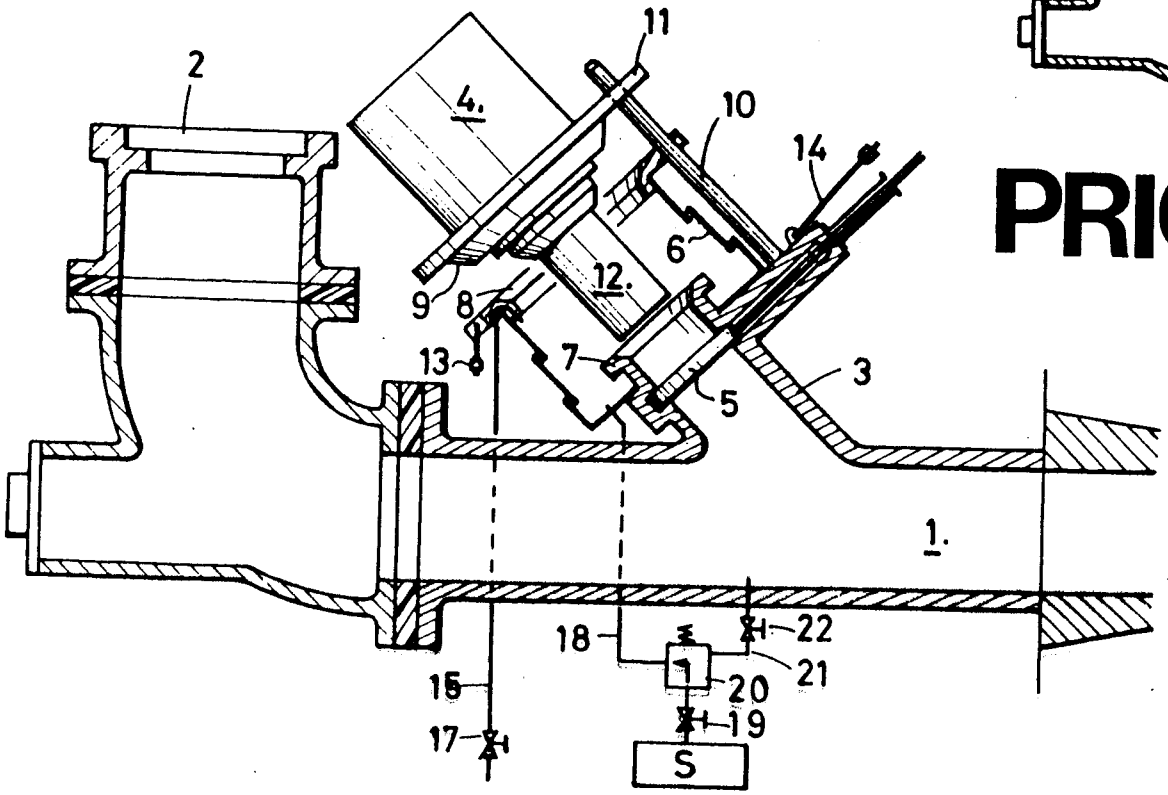
FIG. 2 is an enlarged view similar to FIG. 1 of the device according to the invention.

FIG. 2 shows the device according to this invention for carrying out the method described hereinbefore. This FIG. 2 device may be adapted for the arrangement shown in FIG. 1 substantially without any modification. It comprises an extensible and retractable tubular element 6 fixed in a sealed manner by one end, for example by means of a screw (not shown), around the opening 7 of the sleeve 3. This tubular element 6 may be formed for example by annular metal members slidably mounted one inside the other telescopically and in a sealed manner, in the known way.

At its opposite end, the tubular element 6 is provided with a sealing flange 8, which has a cross-sectional shape suitable for fitting in a sealed manner around a complementary sealing part 9 of the end of the torch 4. Advantageously, at least one guide rod 10 is fixed parallel to the axis of sleeve 3. Slidably mounted thereon are the flange 8 of the tubular element 6 and a flange 11 of the torch 4 set back from its nose 12 around the sealing part 9.

The device further comprises at least one locking means 13 pivotally mounted on the edge of the flange 8, so as to be capable of engaging with the flange 11 of the torch and maintaining the latter in sealed contact with the flange 8. At least one other similar locking means 14 is pivotally mounted on the sleeve 3 and adapted to cooperate, outside the tubular element, 6 with the flange 11 of the torch for the purpose of retaining the latter in the operating position, as will be described hereinafter.

There are provided, on one hand, a pipe 15 connecting the interior of the tubular element 6 to the atmosphere through a tap valve 17, and another pipe 18 connecting the interior of the element 6 to a source S of compressed air through a tap valve 19, and a pilot pressure reducer 20 connected to the interior of the blast pipe 1 through a pipe 21 and a tap valve 22.

FIG. 2 shows the torch 4 in the position in which it is out of use and in which the shut-off valve 5 is closed and the torch is spaced away from the flange 8.

Figure 3:
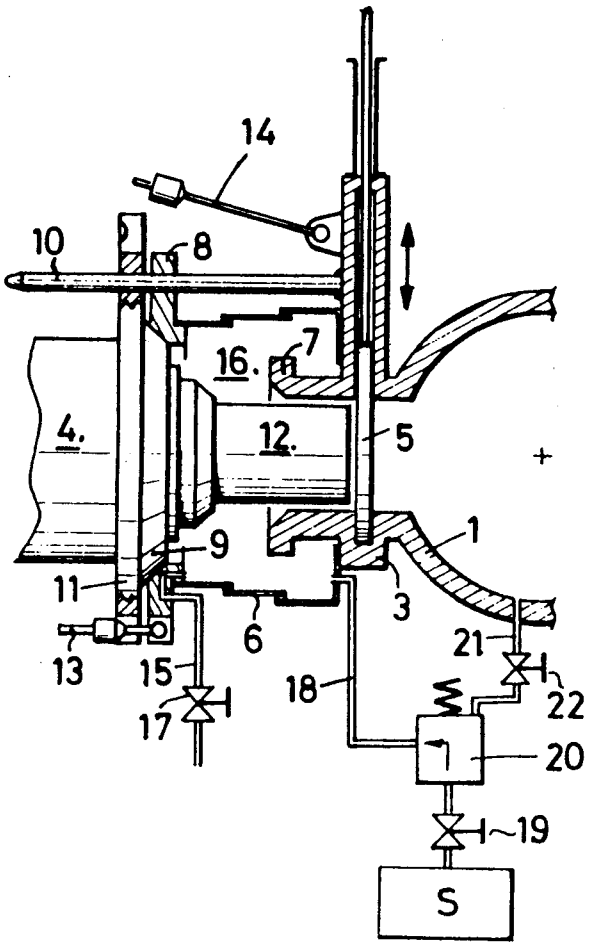

For the purpose of mounting the torch 4 in position on the sleeve, the tap valve 17, 19 and 22 are closed and the torch is slid along the guide 10 so as to bring the sealing part 9 in sealed contact with the flange 8 of the tubular element 6, and they are locked together by the locking means 13, as shown on FIG. 3. In this position, the tubular element 6 defines between the nose of the torch and the sleeve 3 a sealed enclosure or lock chamber 16 of variable volume, closed at one of its ends by the nose of the torch 4 and closed at its opposite end by the valve 5 which is closed.

The tap valves 19 and 22 are then opened so as to bring the lock chamber 16 to a pressure equal to the pressure of the blast pipe, or of the sleeve on the downstream side of the valve 5, by means of the pilot pressure reducing valve 20.

When the pressures are balanced, the shut-off valve 5 is opened and the torch 4 is advanced, thereby reducing at the same time the volume of the chamber 16, which is retracted while bringing simultaneously into operation the plasma producing gas of the torch 4 without striking the electric arc. In this way the nose of the torch is brought to its operating position in contact with the periphery of the opening of the sleeve 3.

Figure 4:
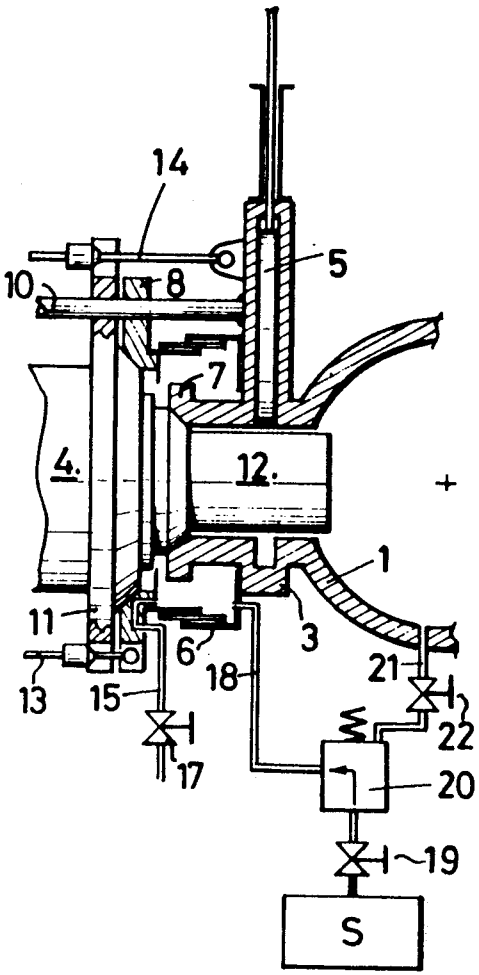
FIGS. 3 and 4 are diagrammatic sectional views showing the operation of the device of FIG. 1.

The torch 4 is then locked in position by the locking means 14 on the flange 11 as shown by FIG. 4, and the tap valve 17 is opened to the atmosphere so as to cool the interior of the lock chamber with the air coming from the source S at a pressure controlled by the pilot pressure reducing valve 20, which is roughly equal to the pressure prevailing on the downstream side of the valve 5.

It will of course be understood that the procedure for withdrawing the torch 4 from sleeve 3 is effected in exactly the same way, but in the reverse order.

In this embodiment, per FIGS. 2–4 the tubular element 6 is made from metal, for example stainless steel, in a plurality members sliding one inside the other in the known manner.

Figure 5:
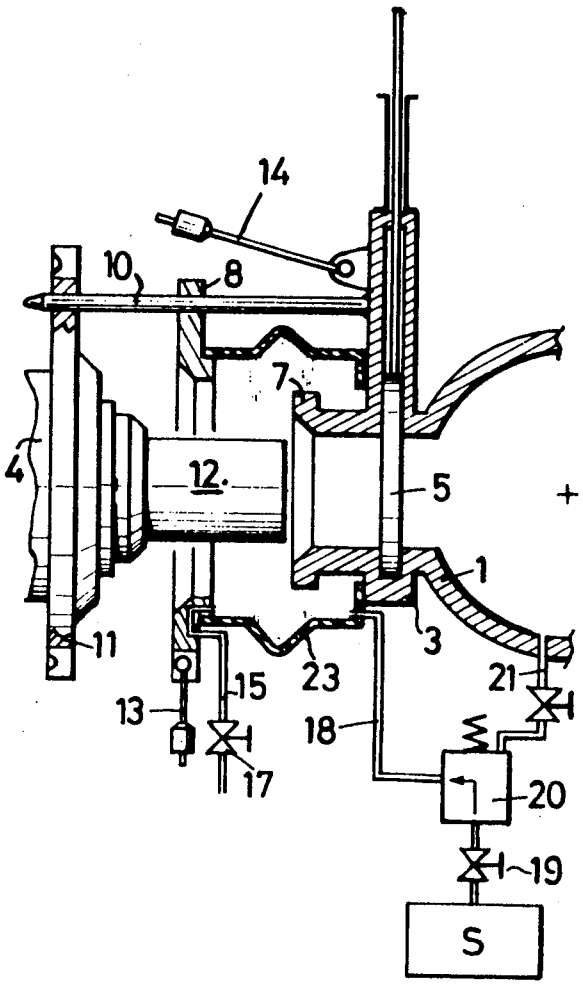
FIG. 5 is a view of a variant arrangement of the invention.

In the variant shown in FIG. 5, the tubular element 23 is made from rubber, or other reinforced elastomer, material for example a bellows with the trademark "VIBROFIX" sold by the firm S.N.R.I. All the other elements are similar to those of the first embodiment of FIGS. 2–4.

Figure 6:
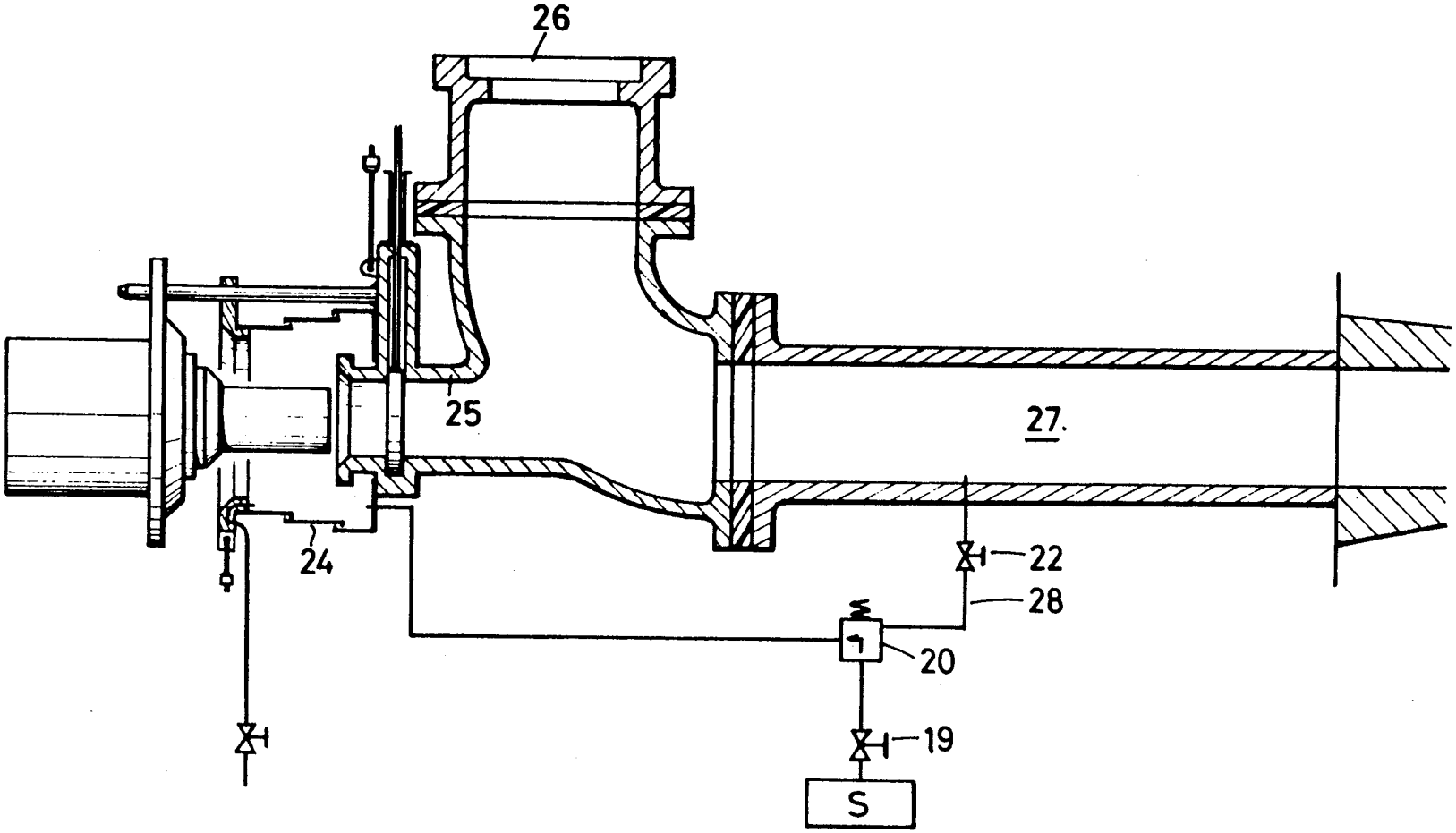
FIG. 6 is a view of another variant of the invention.

In another variant shown in FIG. 6, the tubular element 24 is mounted on a sleeve 25 located at the rear of the hot blast inlet 26 and on the axis of the blast pipe 27. The whole of the device is moreover in every way identical to the preceding embodiment, either with a telescopic metal lock chamber 16 or with an elastomeric bellows. However, in this variant, the pipe 28 connecting the pressure reducing valve 20 to the blast pipe opens onto the latter further away on the downstream side of the hot blast inlet 26 (FIG. 6).

It will be obvious to those skilled in the art that, notwithstanding the fact that the invention is particularly applicable to apparatus provided with a short sleeve, it may also be applied in the case of a long sleeve.

What is claimed is:

1. Method for mounting a plasma torch having a nose and a non-transferred arc on an end of a sleeve which comprises a valve and communicates with a blast pipe of an apparatus operating under high temperature and high pressure conditions, and for withrawing the torch, said method comprising, for mounting the torch:

(a) forming a modifiable closed volume on a upstream side of the valve between the valve and an end of the torch, (b) balancing pressure in said volume with a pressure prevailing on a downstream side of the valve, (c) opening the valve, (d) reducing said volume by advancing the nose of the torch to a mounted position of the torch through said valve, and, for withdrawing the torch:

(e) increasing said volume by rearwardly shifting the nose of the torch, (f) closing the valve, (g) bringing said volume to atmospheric pressure which is lower than the pressure prevailing on the downstream side of the valve, (h) opening said volume.

2. A device adapted for mounting a plasma torch having a non-transferred arc and a nose portion on an end of a sleeve which communicates with a blast pipe of an apparatus operating under high temperature and high pressure conditions, and adapted for withdrawing the plasma torch from the apparatus, said device comprising:

a sleeve adapted for receiving a plasma torch nose portion and containing a shut-off valve;

an extensible and retractable tubular element provided upstream of the shut-off valve and sealably fixed at one end around an end of said sleeve and adapted to receive a nose end of the torch, said tubular element being attachable at its opposite end around said torch nose; and means for balancing pressure inside said tubular element with a pressure prevailing downstream of the shut-off valve.

3. Device according to claim 2, wherein said tubular element is detachably fixed around the torch nose, the device further comprising means for effecting a mutual locking of said tubular element onto the torch.

4. Device according to claim 2, wherein said means for balancing the pressures comprise a source of compressed air, a pipe connected to the interior of said tubular element, a pilot pressure-reducing valve connecting said pipe to said source of compressed air, and a tap valve connecting the pilot pressure-reducing valve to the downstream side of the shut-off valve.

5. Device according to claim 4, wherein a sealing means at the opposite end of the sleeve extends in projection relation into the interior of said tubular element.

6. Device according to claim 2, wherein said tubular element comprises metal members in telescopically sliding relation to one another.

7. Device according to claim 2, wherein said tubular element is a bellows made from a reinforced elastomer material.

8. Device according to claim 2, wherein said torch is mounted on a sleeve which is axially aligned with the blast pipe of the apparatus.

9. A device adapted for mounting a plasma torch having a non-transferred arc and a nose portion on an end of a sleeve which communicates with a blast pipe of an apparatus operating under high temperature and high pressure conditions, and adapted for withdrawing the plasma torch from the apparatus, said device comprising:

a sleeve adapted for receiving a plasma torch nose portion and containing a shut-off valve;

an extensible and retractable tubular element provided upstream of the shut-off valve, said tubular element being sealably fixed at one end around an end of said sleeve and adapted to receive a nose end of the plasma torch, said tubular element being telescopic metal members attachable at its opposite end around said torch nose;

means for locking said tubular element onto the torch; and means for balancing pressure inside said tubular element with a pressure prevailing downstream of the shut-off valve.

* * * * *